US008567318B2

(12) United States Patent
Hayat

(10) Patent No.: US 8,567,318 B2
(45) Date of Patent: Oct. 29, 2013

(54) PROJECTILE LAUNCHING SYSTEM INCLUDING DEVICE FOR AT LEAST PARTLY ENCASING A PROJECTILE

(75) Inventor: Abraham Hayat, Ganey Tikva (IL)

(73) Assignee: Israel Aerospace Industries Ltd., Lod (IL)

( * ) Notice: Subject to any disclaimer, the term of this patent is extended or adjusted under 35 U.S.C. 154(b) by 208 days.

(21) Appl. No.: 12/843,179

(22) Filed: Jul. 26, 2010

(65) Prior Publication Data

US 2011/0023746 A1 Feb. 3, 2011

(30) Foreign Application Priority Data

Jul. 26, 2009 (IL) ..... 200078

(51) Int. Cl.
*F42B 14/00* (2006.01)

(52) U.S. Cl.
USPC ..... 102/520

(58) Field of Classification Search
USPC ..... 102/520, 521–523; 89/1.816
See application file for complete search history.

(56) References Cited

U.S. PATENT DOCUMENTS

| | | | | |
|---|---|---|---|---|
| 982,402 | A * | 1/1911 | Wells | 244/3.23 |
| 3,164,092 | A | 1/1965 | Reed et al. | |
| 3,738,279 | A | 6/1973 | Eyre et al. | |
| 3,802,345 | A | 4/1974 | La Costa | |
| 4,574,703 | A | 3/1986 | Halverson | |
| 4,653,404 | A | 3/1987 | Halverson | |
| 4,706,569 | A * | 11/1987 | Wallow et al. | 102/518 |
| 5,339,743 | A | 8/1994 | Scarlata | |
| 6,829,997 | B1 | 12/2004 | Hilleman | |
| 7,036,434 | B1 * | 5/2006 | Vo et al. | 102/522 |
| 7,549,376 | B1 * | 6/2009 | Grossman et al. | 102/473 |
| 2012/0060715 | A1 * | 3/2012 | Scarr | 102/439 |

* cited by examiner

*Primary Examiner* — Michelle Clement
(74) *Attorney, Agent, or Firm* — Oliff & Berridge, PLC

(57) ABSTRACT

Projectile assembly apparatus comprising a projectile and a projectile head-protecting element surrounding at least a portion of the projectile and operative to separate from the projectile only as the projectile is launched, the projectile head-protecting element including a separation prevention device operative to prevent said projectile head-protecting element from separating from said projectile until a launch-indicative event has occurred.

20 Claims, 21 Drawing Sheets

PROJECTILE LAUNCHING SYSTEM INCLUDING DEVICE FOR AT LEAST PARTLY ENCASING A PROJECTILE

REFERENCE TO CO-PENDING APPLICATIONS

The present application claims priority from Israel Application No. 200078, filed on Jul. 26, 2009.

FIELD OF THE INVENTION

The present invention relates generally to projectile encasing devices such as sabots.

BACKGROUND OF THE INVENTION

Many different kinds of sabots are known, such as those described in U.S. Pat. Nos. 3,164,092, 3,738,279, 3,802,345, 4,574,703, 4,653,404, 5,339,743, 6,829,997. Sabots are one solution, but not the only solution, for encasing some or all of a projectile, typically only until launch, typically to facilitate launching of a projectile whose diameter is much less than that of the barrel of the launcher.

Both smoothbore and rifled firearm barrels are known. Rifling refers to a helical pattern of grooves along the inside diameter of a barrel which imparts spin to an exiting projectile about the long axis thereof, thereby gyroscopically stabilizing and when necessary "averaging out" minor structural discrepancies of the projectile that might otherwise shift the trajectory, so as to enhance its accuracy. Rifling is characterized by a "twist rate" typically indicating the distance or number of diameters a projectile travels while completing one full revolution, such as "1 turn in 10 inches" (1:10 inches), "1 turn in 30 cm" (1:30 cm), or 18 (e.g.) barrel diameters per turn. Rifling is typically formed by cutting out "grooves"; the resulting ridges are called lands. The number of grooves (or ridges) may for example be 28 or 30, for a 120 mm barrel.

The disclosures of all publications and patent documents mentioned in the specification, and of the publications and patent documents cited therein directly or indirectly, are hereby incorporated by reference.

SUMMARY OF THE INVENTION

To launch a projectile from a barrel, where the diameter of the projectile is less than that of the barrel, a projectile head protective element such as but not limited to a sabot is typically used to envelop the projectile, thereby both protecting the projectile and sealing the barrel. For example, the barrel diameter might be 120 mm whereas the projectile diameter might be only 105 mm. If a sabot has no protective function, it sometimes is constructed to envelop only the tail end of the projectile. In this case, a mechanism to hold the sabot and projectile together until launch and to allow them to separate during launch, can be built into the cartridge i.e. at the tail end of the sabot. However certain sabots are also intended to protect the head of the projectile, which may be a homing head or otherwise be delicate or in need of support and protection e.g. during storage. If this is the case, it would be advantageous to provide a mechanism to hold the head ends of the sabot, or more generally the head protective element and projectile together, until launch and to allow the head ends of the head-protecting element and projectile to separate during launch.

Certain embodiments of the present invention seek to provide an improved projectile head protective device. There is thus provided, in accordance with at least one embodiment of the present invention, weaponry apparatus comprising a projectile and a projectile head-protecting element surrounding at least a portion of the projectile head and operative to separate from the projectile only as the projectile is launched, the projectile head-protecting element including a separation prevention device operative to prevent the projectile head-protecting element from separating from the projectile until a launch-indicative event has occurred.

Further in accordance with at least one embodiment of the present invention, the apparatus also comprises launching apparatus including a barrel from which the projectile is launched.

Still further in accordance with at least one embodiment of the present invention, the projectile has a forward acceleration during launch and wherein the launch-indicative event comprises a situation in which the forward acceleration of the projectile reaches a level high enough to be indicative of launching.

Additionally in accordance with at least one embodiment of the present invention, the projectile comprises a susceptible head such as a homing head which is susceptible to damage and the projectile head-protecting element protects the susceptible head.

Further in accordance with at least one embodiment of the present invention, the separation prevention device is operative to prevent the head protection portion from separating from the projectile until a current forward acceleration of the projectile reaches a level high enough to be indicative of launching.

Still further in accordance with at least one embodiment of the present invention, the projectile head-protecting element comprises a front portion of a projectile enveloping element.

Additionally in accordance with at least one embodiment of the present invention, the projectile defines an axis along the forward direction and a circumference surrounding the axis and wherein the projectile head-protecting element includes at least first and second projectile head-protecting element segments arranged about the circumference of the projectile, wherein the first projectile head-protecting element segment comprises a spring loaded weighted connector, having a first position, and a second position when a force contrary to the spring force is applied to the weighted connector, wherein the connector is configured and arranged to connect the first projectile head-protecting element segment to the second projectile head-protecting element segment when the connector is in the first position and not when the connector is in the second position, and wherein the connector is positioned such that at least a portion of the forward acceleration of the projectile works against the spring force.

Further in accordance with at least one embodiment of the present invention, the first projectile head-protecting element segment is no longer connected to the second projectile head-protecting element segment by the spring loaded weighted connector once the forward acceleration overcomes the spring force.

Further in accordance with at least one embodiment of the present invention, the barrel comprises a smoothbore barrel.

Still further in accordance with at least one embodiment of the present invention, the apparatus also comprises a connector disabler operative to prevent the connector element from re-connecting the first and second projectile head-protecting element segments once the connector element has reached the second position.

Additionally in accordance with at least one embodiment of the present invention, the barrel comprises a rifled barrel, and the separation prevention device comprises a toothed separation prevention device operative to perform a spin motion around the projectile as the projectile and surrounding projectile head-protecting element move along the rifled barrel, the toothed device being operative to prevent the projectile head-protecting element from separating from the projectile until at least one characteristic of the spin motion has reached a level unique to launching.

Still further in accordance with at least one embodiment of the present invention, the toothed separation prevention device includes pre-formed teeth.

Further in accordance with at least one embodiment of the present invention, the characteristic comprises a number of times that the device spins around the projectile and wherein the device is operative to prevent the projectile head-protecting element from separating from the projectile until the number of times is high enough to be indicative of launching.

Still further in accordance with at least one embodiment of the present invention, the projectile defines an axis along the forward direction and a circumference surrounding the axis and wherein the projectile head-protecting element includes at least first and second projectile head-protecting element segments arranged about the circumference of the projectile, wherein the rifled barrel defines a first threading direction and wherein the device is peripheral to and in threaded engagement with the first and second projectile head-protecting element segments, thereby to define a second threading direction which may be the same as the first threading direction.

Additionally in accordance with at least one embodiment of the present invention, the rifled barrel defines a first number of revolutions and the threaded engagement of the device with the projectile head-protecting element defines a second number of revolutions along the barrel which is smaller than the first number of revolutions.

Still further in accordance with at least one embodiment of the present invention, the separation prevention device comprises a toothed threaded wheel whose weight is radially-unevenly distributed to promote sideways motion of the wheel, after the wheel has exited a barrel, thereby to enable the projectile to proceed without interference.

Additionally in accordance with at least one embodiment of the present invention, the projectile enveloping element comprises a sabot.

The embodiments referred to above, and other embodiments, are described in detail in the next section.

Any trademark occurring in the text or drawings is the property of its owner and occurs herein merely to explain or illustrate one example of how an embodiment of the invention may be implemented.

BRIEF DESCRIPTION OF THE DRAWINGS

Certain embodiments of the present invention are illustrated in the following drawings.

DETAILED DESCRIPTION OF CERTAIN EMBODIMENTS

Figure 1:
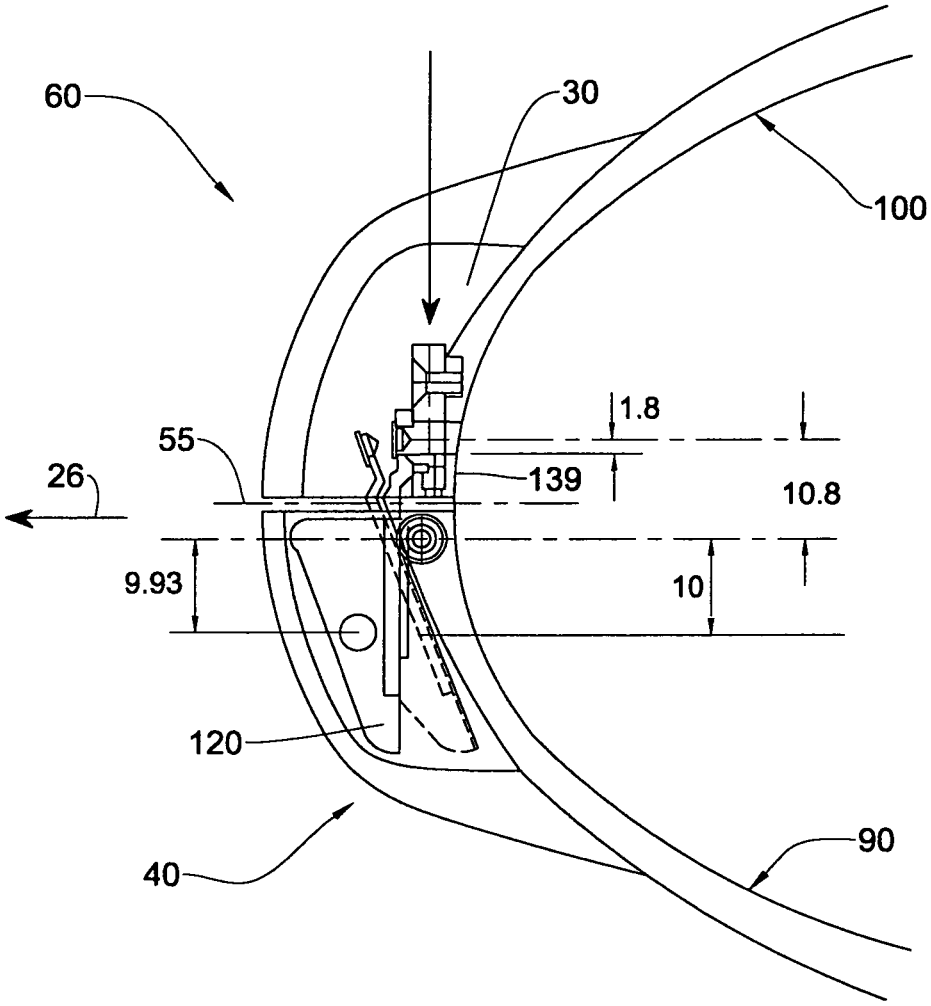
FIG. 1 is a simplified side cross-sectional illustration of a projectile head protective element such as but not limited to a sabot and associated separation prevention device constructed and operative in accordance with a first embodiment of the present invention and typically including at least two head-protecting element segments, the particular measurements provided being merely by way of example and not being intended to be limiting.

A sabot is a device used in a firing weapon having a barrel, such as a firearm or cannon, to fire a projectile such as a bullet or shell whose diameter is less than the bore defined by the barrel. The sabot typically fills in the gap between projectile and barrel thereby typically facilitating centering of the projectile, enhancing the seal which entraps, behind the projectile, those gasses which propel the launch process, and increasing projectile acceleration. Typically, the sabot includes two or more lightweight segments which separate from the projectile so as not to accompany it during its flight.

Other projectile protective devices which at least partially encase a projectile may not be considered sabots e.g. because their function is merely to protect a delicate head such as a homing head.

FIGS. 1-11 illustrate projectile assembly apparatus comprising a projectile 10 (FIGS. 10A-10B), a cartridge 15 and a projectile head-protecting element 60. Projectile head-protecting element segments 90 and 100 may, as in the illustrated embodiment, comprise a front portion of a projectile enveloping element, such as a sabot, enveloping at least a portion of, or all of, the projectile other than the head. Projectile head-protecting element 60 is sometimes termed herein, a "sabot", however this is not intended to be limiting. The head protecting element surrounds at least a portion of the projectile 10 and is operative to separate from the projectile 10 only as the projectile 10 is launched from a barrel. Head-protecting element 60 typically includes a separation prevention device 30 operative to prevent head-protecting element 60 from separating from the projectile 10 until a launch-indicative event has occurred.

According to one embodiment of the present invention, in which the barrel may comprise a smoothbore or rifled barrel, the launch-indicative event whose occurrence results in head-protecting element-projectile separation comprises a situation in which the forward acceleration of the projectile 10 reaches a level high enough to be indicative of launching, such as 30-50 G for a soft launch at 70-150 G. The forward direction is indicated in FIG. 1 by arrow 26.

Typically, projectile 10 comprises an elongate projectile having a head such as a homing head 40 requiring protection and a tail 50 and the head protecting element 60 protects the head of the projectile 10. The separation prevention device 30 is, according to certain embodiments of the present invention, operative to prevent the head protection portion 60 from separating from the projectile 10 until a current forward acceleration of the projectile 10 reaches a level high enough to be indicative of launching.

Figure 5:
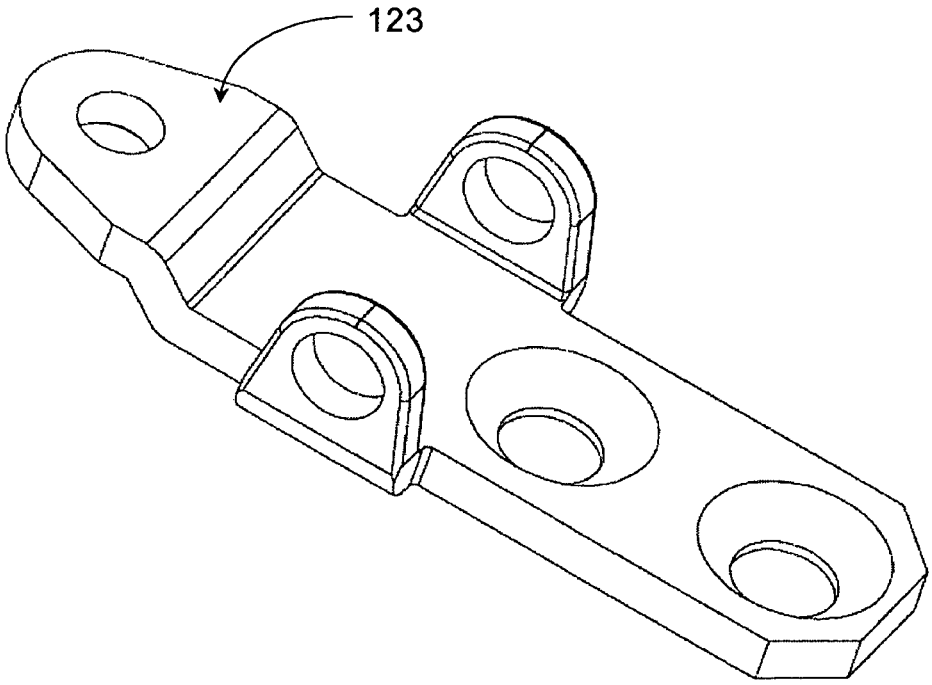
FIG. 5 is an isometric view of the fork element of FIG. 4.
Figure 6:
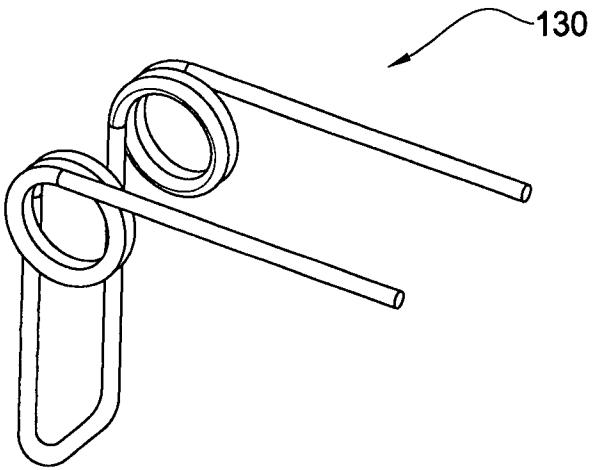
FIG. 6 is an isometric view of the torsion spring of FIG. 4 in its unloaded state.
Figure 7:
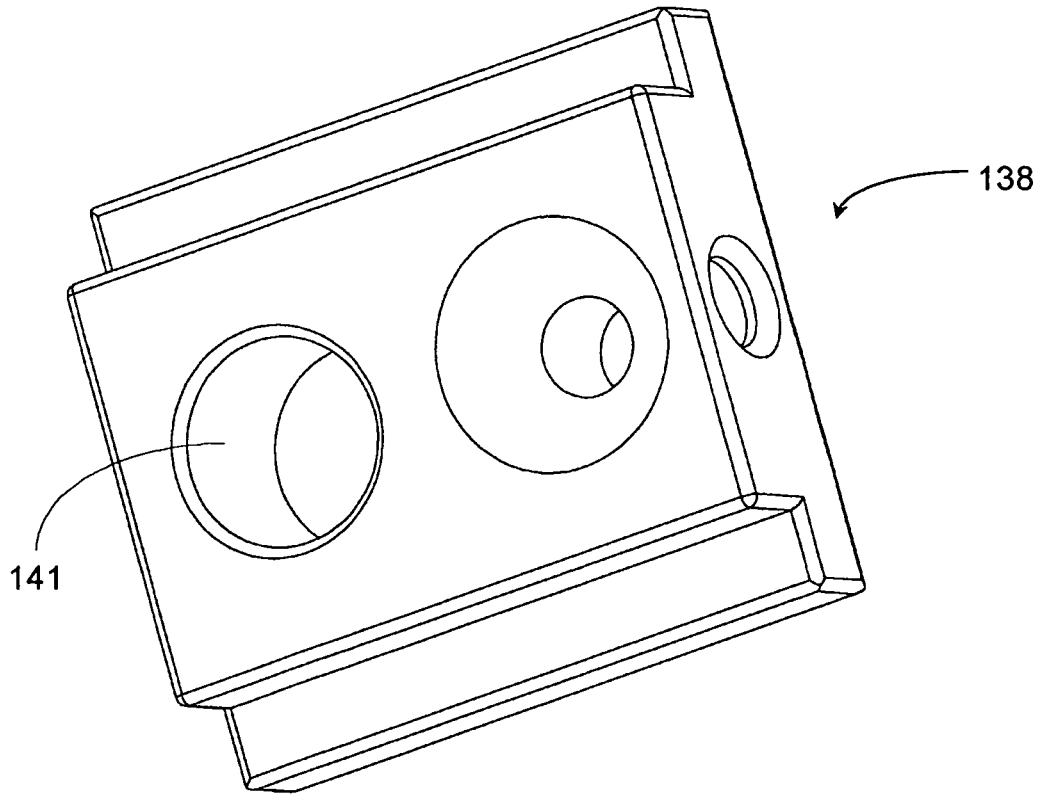
FIG. 7 is an isometric view of the slider element of FIGS. 3A-3B.
Figure 8B:
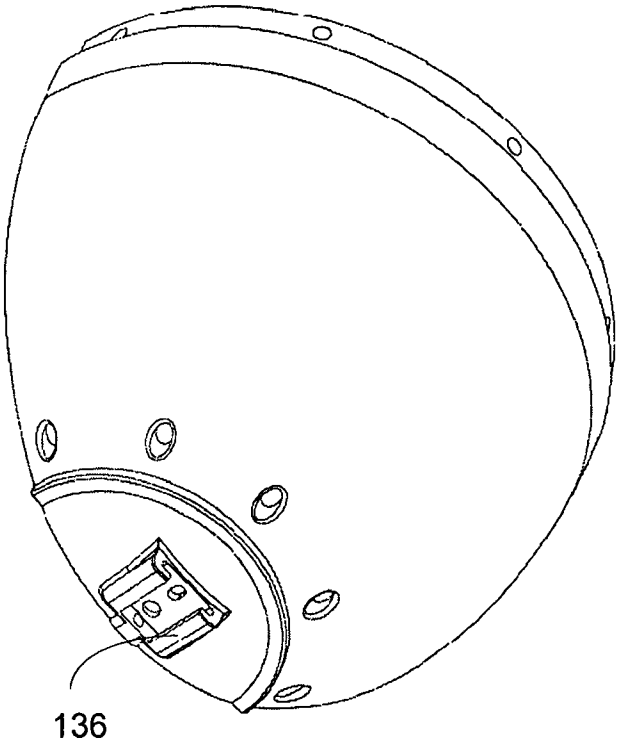
FIGS. 8A-8B are isometric views of a slider socket configured to receive the slider element of FIG. 7 and being mounted on the second head-protecting element segment.
Figure 8A:
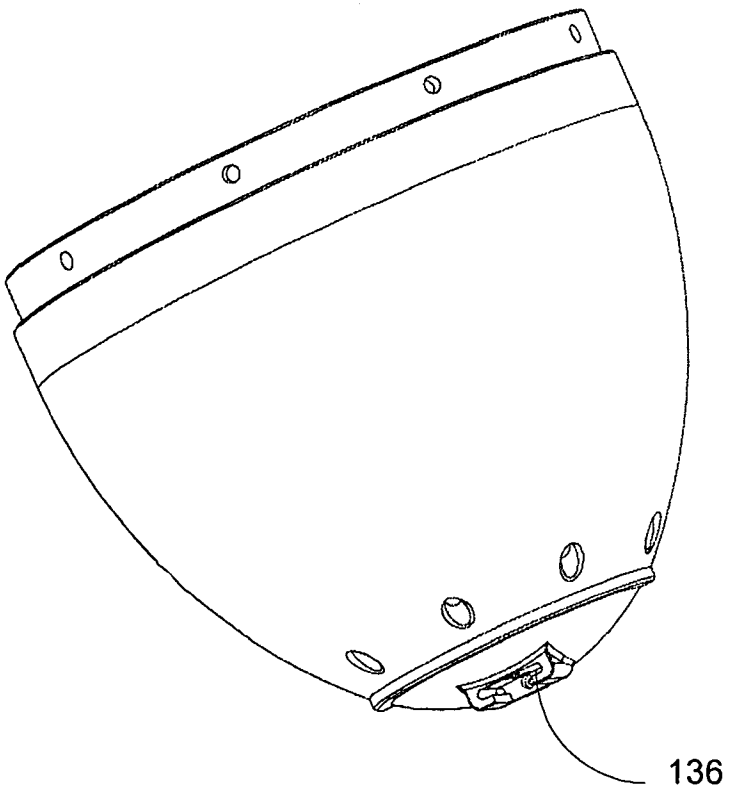
Figure 9:
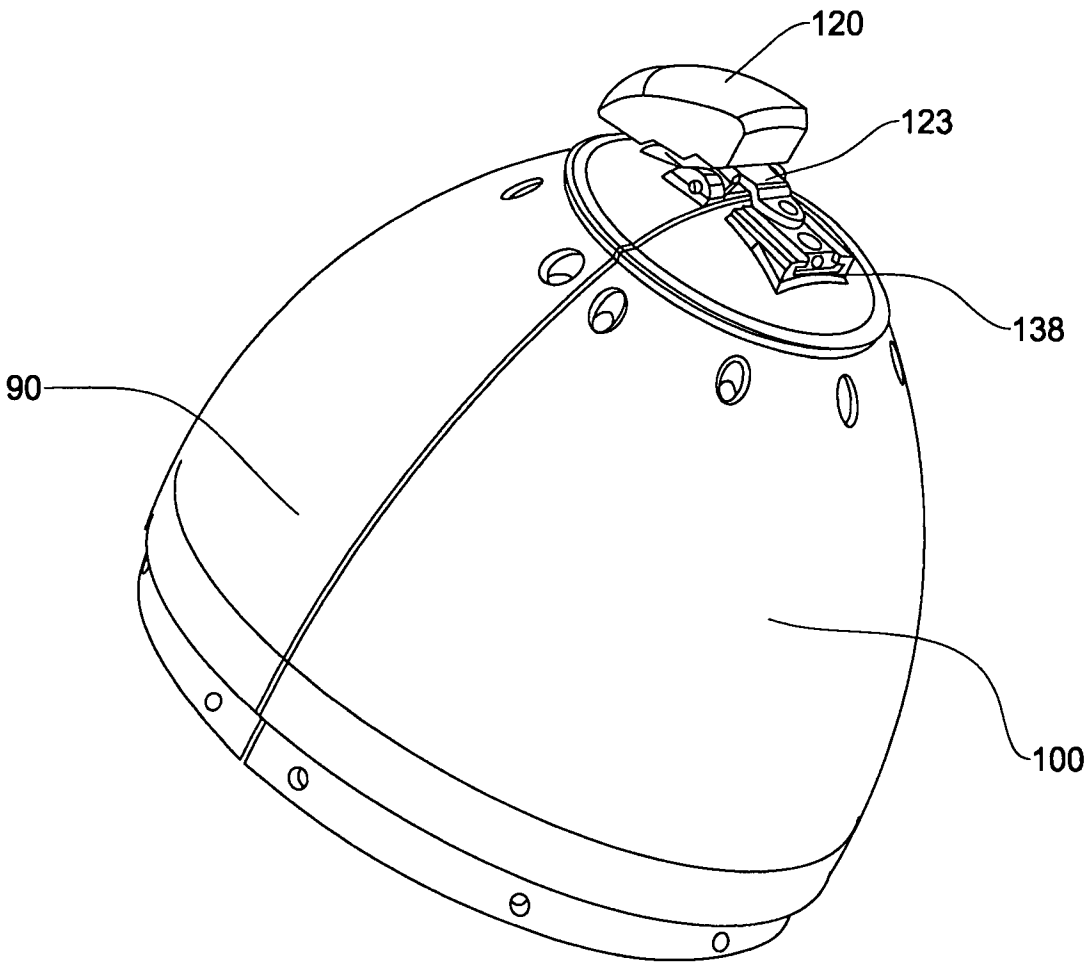
FIG. 9 is an isometric view of the first and second head-protecting elements in locking engagement with one another prior to launch.

As shown, projectile 10, being elongate, defines an axis 55 (FIG. 1) along the forward direction and a circumference surrounding the axis and the head-protecting element, which in the illustrated embodiment may be a sabot, includes at least two head-protecting element segments, such as 2-8 segments, including at least first and second head-protecting element segments 90 and 100. These segments are arranged about the circumference of the projectile. If there are two head-protecting element segments, as in FIG. 1, each segment envelops 180 degrees of the circumference of the projectile. If there are n>two head-protecting element segments, each segment typically envelops 360/n degrees of the circumference of the projectile. The first head-protecting element segment typically comprises a spring loaded weighted connector 110 (FIG. 4) including a weight 120 mounted via a fork element 123 (FIG. 6) and a pivot bushing 125 on a spring such as a helical torsion spring 130 as shown in FIG. 5. The connector 110 has a first position, and a second position when a force contrary to the spring force is applied to the weighted connector 110. The connector is configured and arranged to connect the first head protecting element segment 90 to the second head protecting element segment 100 via a locking pin 135 mounted on the fork element 123 when the connector 110 is in the first position and not when the connector is in the second position. As shown, the connector 110 is positioned such that at least a portion of the forward acceleration of the projectile works against and, if the acceleration is high enough, overcomes the force of the spring 130 and any other impeding frictional forces.

Figure 10A:
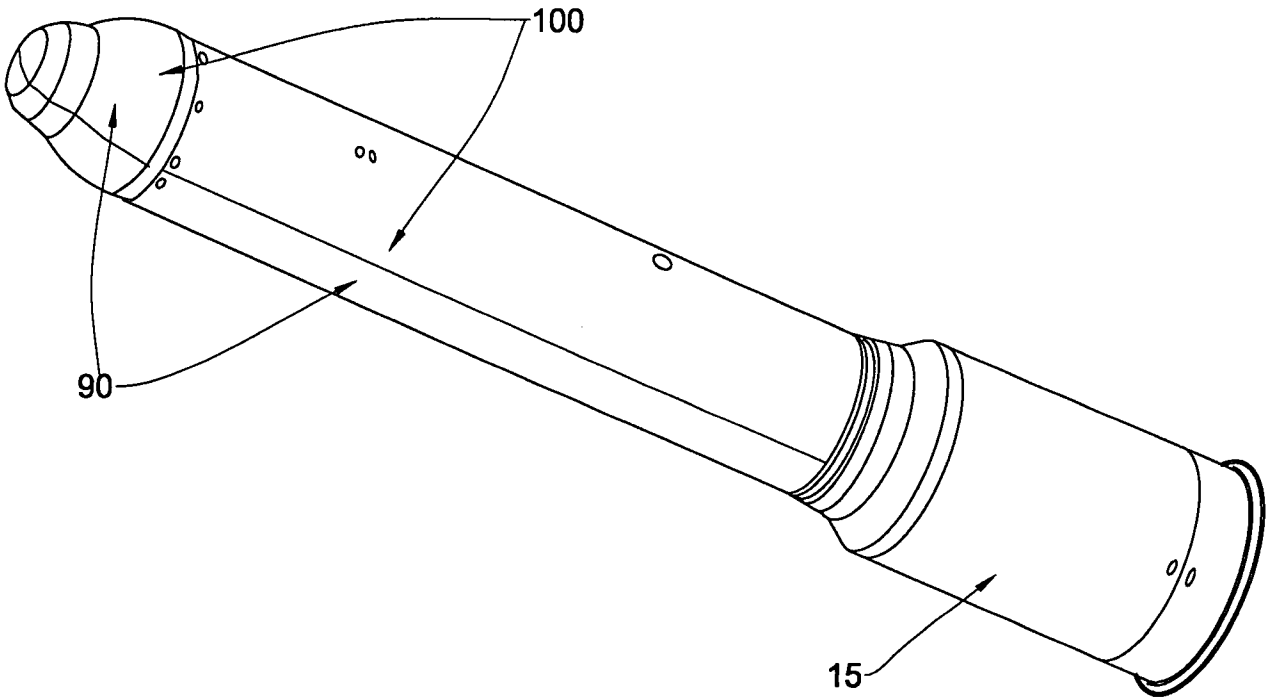
FIG. 10A is an isometric view of a locked missile-sabot system having the lock-release mechanism of FIGS. 1-9.
Figure 10B:
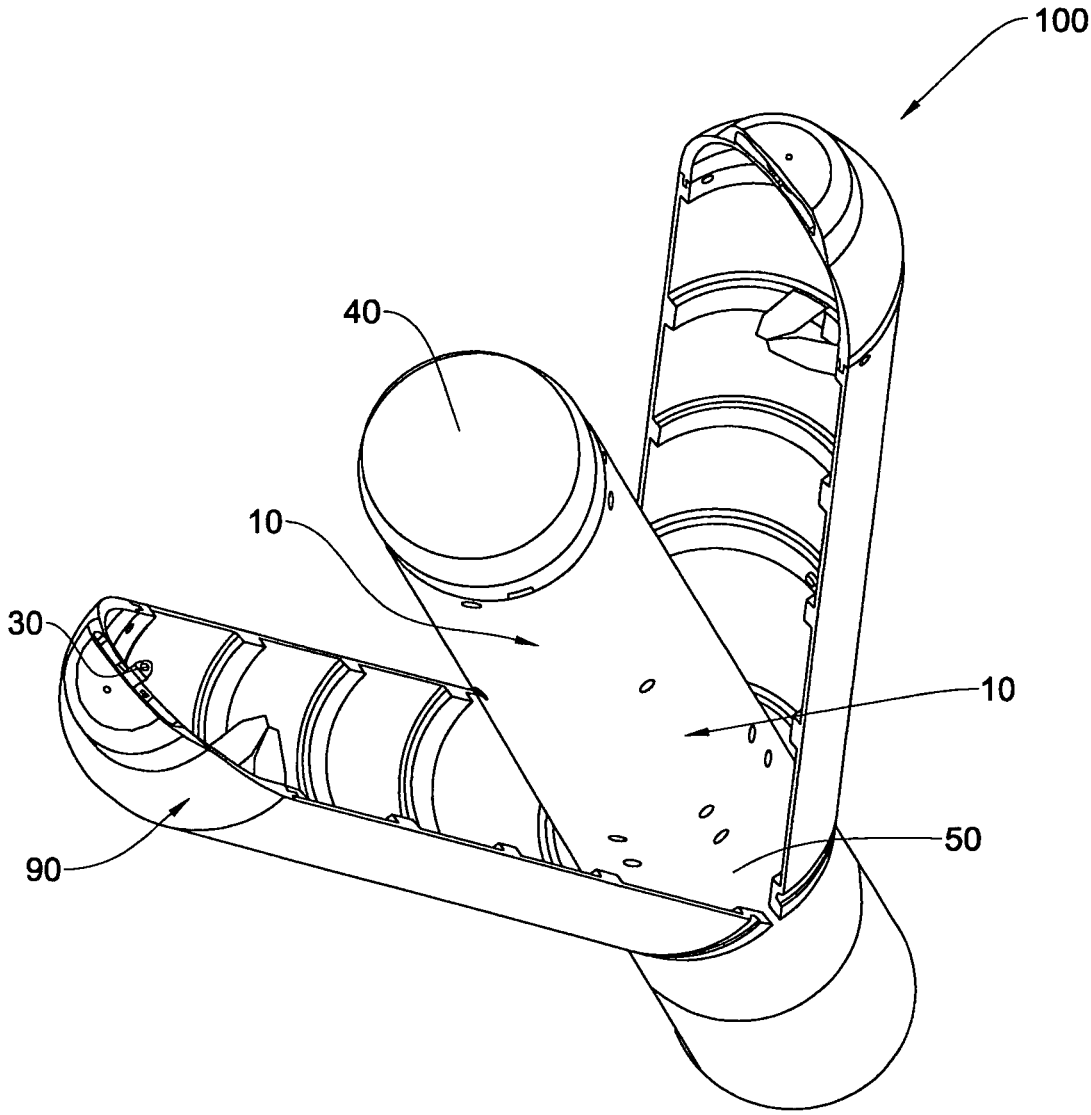
FIG. 10B is an isometric view of a missile-sabot system after its missile has been fired, the lock-release mechanism has entered its release position, the sabots have separated, and the missile has left the cannon barrel.

As shown in FIG. 10B, the first head-protecting element segment 90 is no longer connected to the second head-protecting element segment 100 by the spring loaded weighted connector once the forward acceleration overcomes the spring force.

Figure 2A:
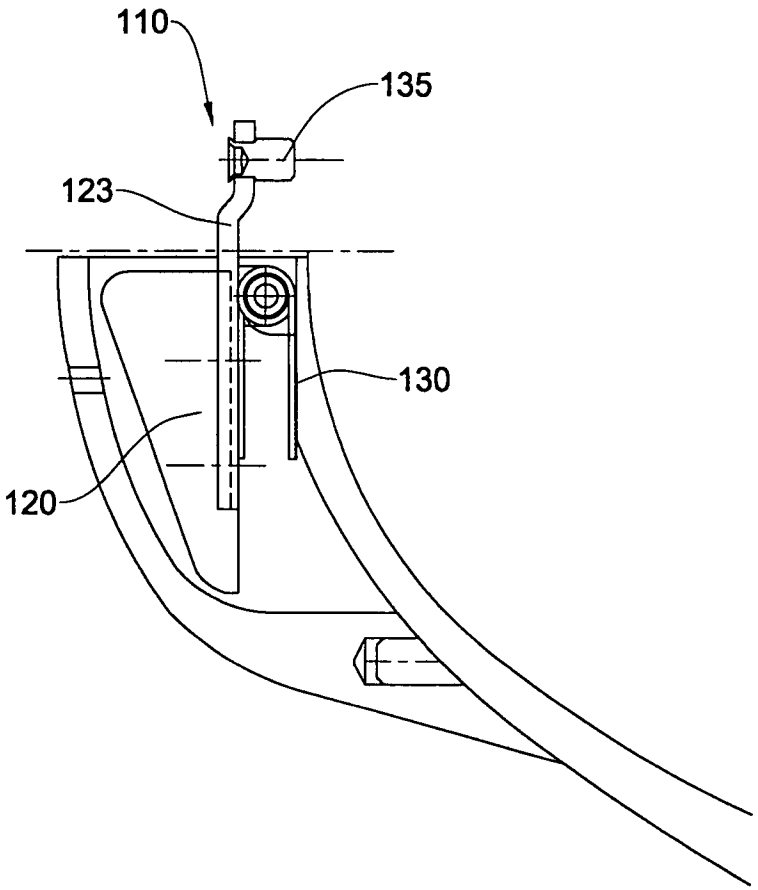
FIGS. 2A, 2B and 2C are simplified side cross-sectional illustrations of a first head-protecting element segment of FIG. 1, in a first, locked position; a second, released position and a third, post-launch position, respectively.
Figure 2B:
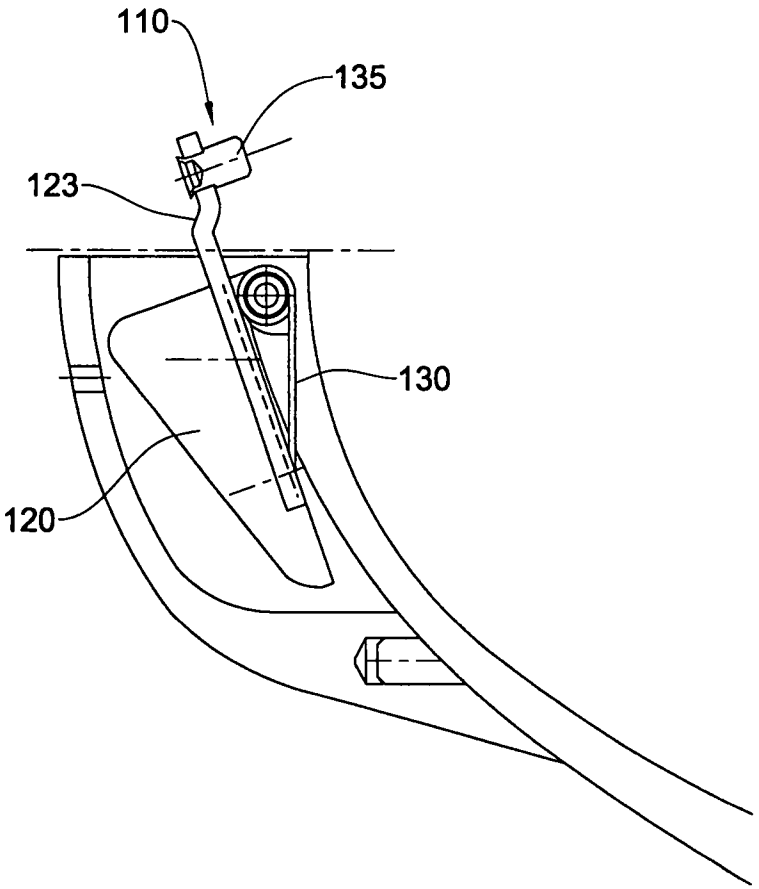
Figure 3A:
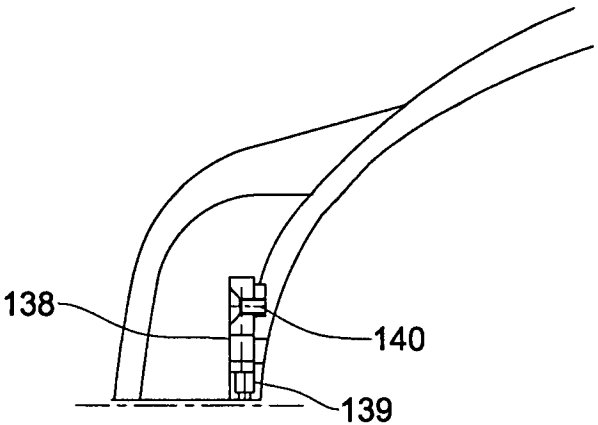
FIGS. 3A-3B are simplified side cross-sectional illustrations of a second head-protecting element segment 100 of FIG. 1, in a first, locked position and a second, released position respectively, in which a slider element may be compressed by a compression spring and a limit screw; and an aperture in the slider element engages the pin or finger element of FIG. 2A.
Figure 3B:
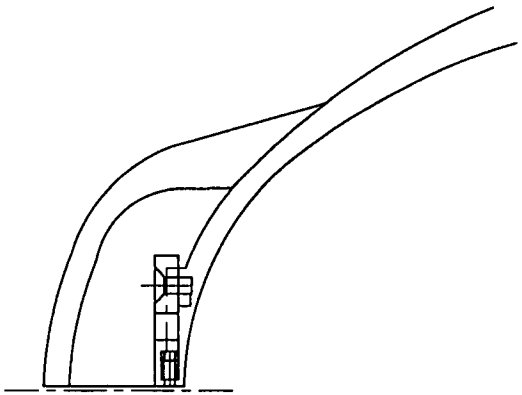
Figure 4:
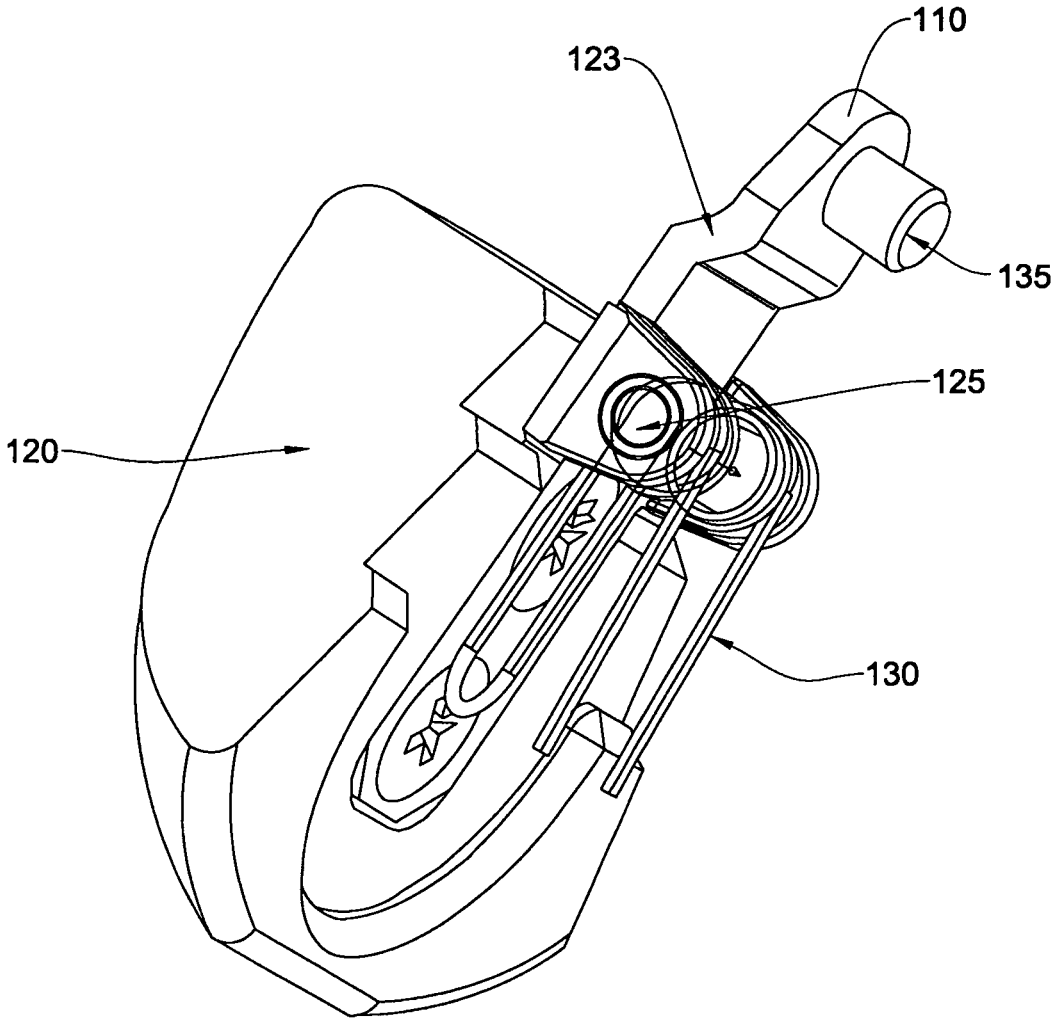
FIG. 4 is an isometric view of the lock-release mechanism of FIGS. 2A-2B.

The first and second head-protecting element segments 90 and 100 retain their locked positions, as shown in FIGS. 2A and 3A respectively, during storage and more generally in the absence of acceleration along the firing axis of the projectile, which causes a force whose magnitude exceeds the resistance force of the torsion spring combined with the friction inherent in the system. The first and second sabots 90 and 100 revert to their released positions, as shown in FIGS. 2B and 3B respectively, when the acceleration of the projectile 10 within the barrel is high enough to enable the weight to overcome friction and the force of the torsion spring, such that the weight 120 enters into motion about the rotation axis of the weighted connector 110. As a result, the locking pin 135 slides out of apertured slider element 138 (FIG. 7) slidably associated with a slider socket 136 mounted (FIGS. 8A-8B) on second head protecting element segment 100 thereby disengaging the first and second sabot elements 90 and 100 from one another. Optionally, the torsion spring 130 is prevented from locking the weight 120 into place once again. For example, in the illustrated embodiment, the slider 138 of second sabot 100 translates responsive to release of a spring 139 (FIG. 3A) such that re-entry of the pin 135 into the pin-receiving aperture 141 (FIG. 7) in the slider 138, is no longer possible.

Figure 2C:
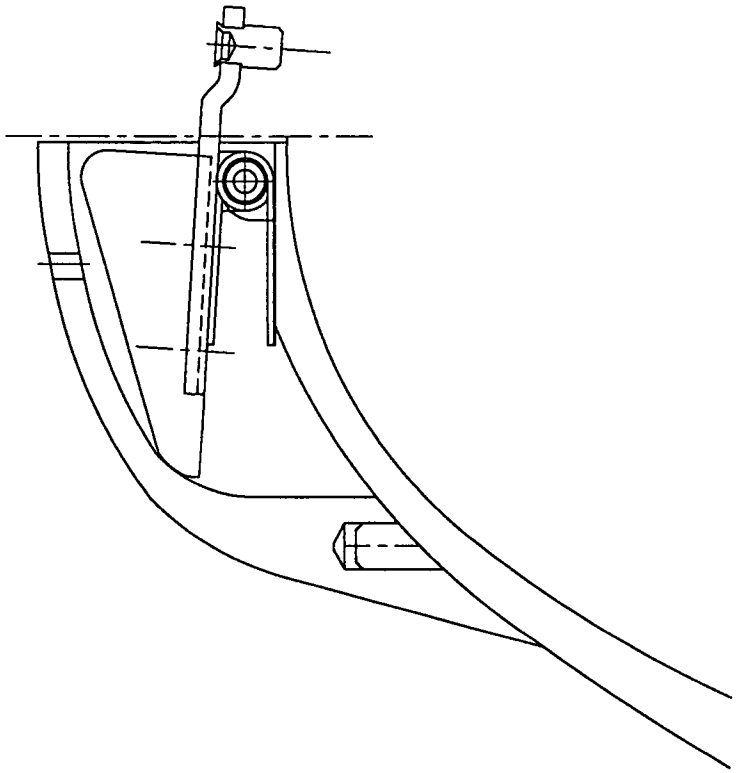

More generally, a connector disabler is operative to prevent the connector element 110 from re-connecting the first and second head protecting element segments 90 and 100 once the weighted connector 110 has reached the second position. In the illustrated embodiment, by way of example only, the first head protecting element segment 90 includes a protruding finger element 135, the head protecting element 100 includes a matching socket 141 through which the finger element normally (i.e. pre-launch) extends, and a socket-controlling spring 139 is configured and arranged to be compressed until launch and, upon release, to either close or move the socket such that the finger element can no longer slide through the socket. Conversely, when the acceleration of the projectile 10 is so high as to overcome the force of the spring 130, the finger element is retracted out of the socket and the spring is released to either close or move the socket to prevent re-entry of the finger into that socket. After leaving the barrel, typically, head protecting element segment 100 returns to its released state (FIG. 3B) and sabot 90 returns to a state similar to the locked state of FIG. 2A except that the weight 120 is slightly raised (FIG. 2C).

Numerical Example

The particular dimensions and parameters shown in FIG. 1 and elsewhere are of course merely by way of example and are not intended to be limiting. The particular dimensions and parameters shown pertain to a 120 mm tank gun operative to "soft-launch" a 105 mm laser homing attack missile which normally involves accelerations in the range of 70 G-150 G, however it is appreciated that the scope of the present invention is not limited to any aspect of this particular application and also includes, inter alia, applications which are not soft launches such as firing of a gun which may generate accelerations of up to 20,000 G. It is appreciated that the dimensions and parameters are selected so as to ensure release of the head-protecting element well before firing time, and simultaneously to prevent release of the head-protecting element in all situations in which accelerations typical of launch do not occur. In the numerical example shown, the parameters and dimensions have been selected such that, as shown in the four example computations below, if the acceleration reaches 50 G the head-protecting element is released even if the friction is relatively high (0.2); if the acceleration is 30 G the head-protecting element will be released for low-friction (0.1) set-ups and not for high-friction (0.2) set-ups; if the acceleration is 20 G, then even though this level of acceleration occurs, with a very high degree of probability, only during launch, nonetheless, in this example, the head-protecting element is, due to safety considerations, not released even when friction is very low (e.g. only 0.05 in the example below).

1.
when:
acceleration 20 G
friction 0.05

[4+0.1] kg×0.05=205

205×[10.6−1.6]+800×10=9845 gram/mm (40.35 gram×20 g)×9.93=8013.5 gram/mm

9845>8013.5 hence head-protecting element is not released 2.
when:
acceleration 30 G
friction 0.2

[4+0.1] kg×0.2=820

820×(10.6−1.6)+800×10=15380 gram/mm (40.35 gram×30 g)×9.93=12020.2 gram/mm

15380>12020.2 hence head-protecting element is not released 3.
when:
acceleration 30 G
friction 0.1

[4.0+0.1] kg×0.1=410

410×[10.6−1.6]+800×10=11690 gram/mm (40.35 gram×30 g)×9.93=120202 gram/mm 12020.2>11690 hence head-protecting element is released 4.
when:
acceleration 50 G
friction 0.2

[4+0.1] kg×0.2=820

820×(10.6−1.6)+800×10=15380 gram/mm

[40.35 gram×50 g]×9.93=20033.8 gram/mm 20033.8>15380 hence head-protecting element is released.

It is appreciated that the missing acceleration at firing time may be, say, 70 G-108 G depending on the temperature which may vary from extremes of, say, −40 degrees Celsius to 60 degrees Celsius.

Figure 11:
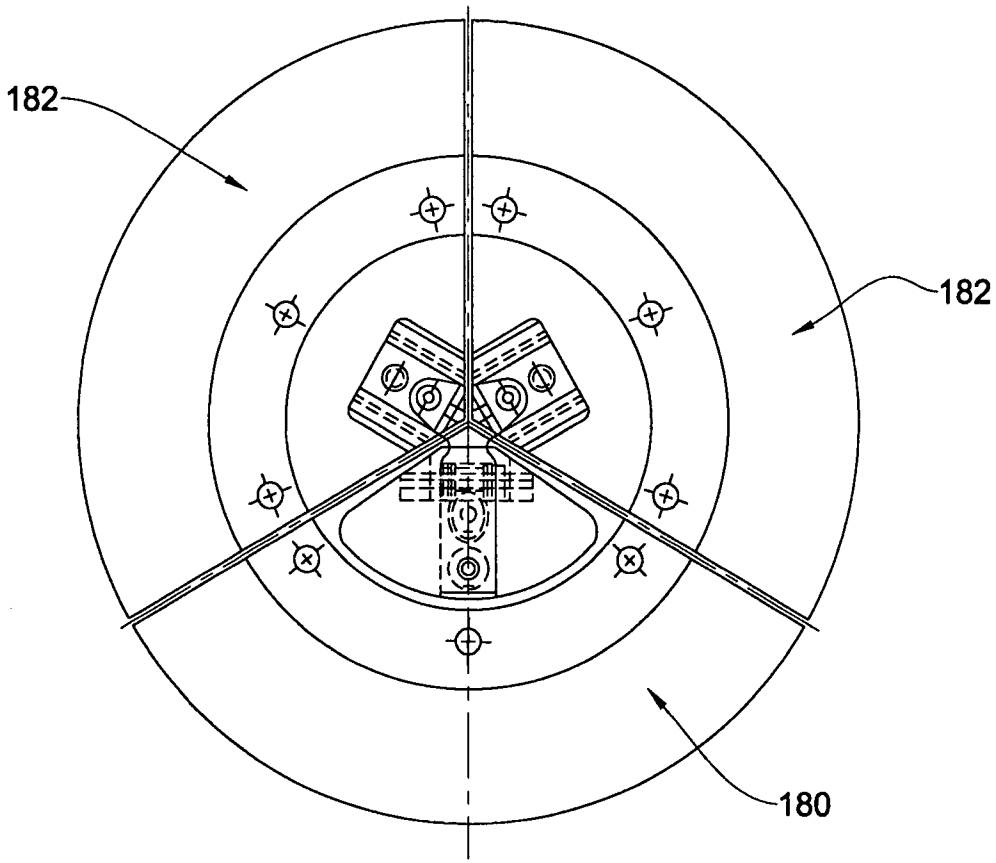
FIG. 11 is a cross-section illustration of a variation of the apparatus of FIGS. 1-9 suitable for applications in which the head protecting element includes more than two head-protecting element segments, such as three head-protecting element segments as shown, each covering 120 degrees of the circumference of the projectile rather than 180 degrees thereof, and the fork element has two arms with two respective locking pins rather than one of each as in FIG. 5, so as to control engagement between a first head-protecting element segment and both of the remaining two head-protecting element segments.

FIG. 11 is a cross-section illustration of a variation of the apparatus of FIGS. 1-11 suitable for applications in which the head-protecting element includes more than two head-protecting element segments shown at reference numerals 180 and 182, such as three head-protecting element segments as shown each covering 120 degrees of the circumference of the projectile 10. Typically, head-protecting element segment 180 is similar to the first head-protecting element segment 90 described above except that two pins, rather than one, are mounted on the fork so as to lock into both of segments 182 rather than into only one head-protecting element segment as in the embodiment of FIGS. 1-10B. Segments 182 are each typically similar to the second head-protecting element segment 100 described above. If, to give another example, four head-protecting element segments are provided, each covering 90 degrees of the projectile circumference, these may include two "blank" segments with no particular lock-release mechanism, and two interspersed head-protecting element segments respectively similar to the first and second head-protecting element segments 90 and 100 described above except that they lock into each other, across the two "blank" segments, rather than locking into circumferentially adjacent head-protecting element segments.

In the embodiment of FIGS. 1-11, as soon as the separation prevention device is inactivated, the head protecting element is effectively separated from the projectile 10 except that, of course, the internal walls of the barrel itself prevent full separation of the head-protecting element and projectile 10 until the two have emerged from the barrel. A suitable spring may facilitate initial separation of the head-protecting element from the projectile 10 once the two have emerged from the barrel. While in storage and in the barrel, the head-protecting element is typically loosely secured to the projectile at the base of the projectile by suitable securing means e.g. by a suitable bracket, such that once the head-protecting element segments have separated to a non-trivial extent from the projectile (say about 30 degrees), the base portions of the head-protecting element segments 90 and 100 slip free from the base portion of the projectile.

FIGS. 12-18 illustrate a second embodiment of the apparatus of the present invention in which the barrel (not shown) comprises a rifled barrel, and the separation prevention device is toothed, typically comprising a threaded toothed wheel 230 (FIGS. 12-13B, 15) and is operative to perform a spin motion around projectile 10 as the projectile 10 and a surrounding protective element, such as a head-protecting element, move along the rifled barrel. The teeth 235 of the toothed separation prevention device may be preformed, as in the illustrated embodiment, or alternatively may form during launch as a result of the separation prevention device proceeding at high acceleration along the rifled barrel. The toothed separation prevention device is operative to prevent the head-protecting element from separating from projectile 10 until at least one characteristic of the spin motion has reached a level unique to launching. This characteristic may for example comprise a number of times that the toothed separation prevention device 230 spins around the projectile 10 in which case the toothed separation prevention device 230 is operative to prevent the head-protecting element (e.g. 260 in FIG. 17) from separating from the projectile 10 until the number of revolutions of separation prevention device 230 around projectile 10 is high enough to be indicative of launching.

The firing direction of the projectile enveloped by the head-protecting element is indicated by arrow 300. As shown, the front portion of the external surface of each head-protecting element segment may be threaded, for example with double threading 215 including two helically interspersed threads emerging from the same azimuthal location and having the same pitch, so as to provide interchangeability between the two head-protecting element segments. More generally, if N projectile encasing element segments such as but not limited to head-protecting element segments are provided, the threading may optionally include N or 2N or, more generally kN helically interspersed threads where k is an integer, rather than a single such thread, wherein if the same number of initial threading locations is provided per segment, interchangeability between the N segments is achieved.

Figure 12:
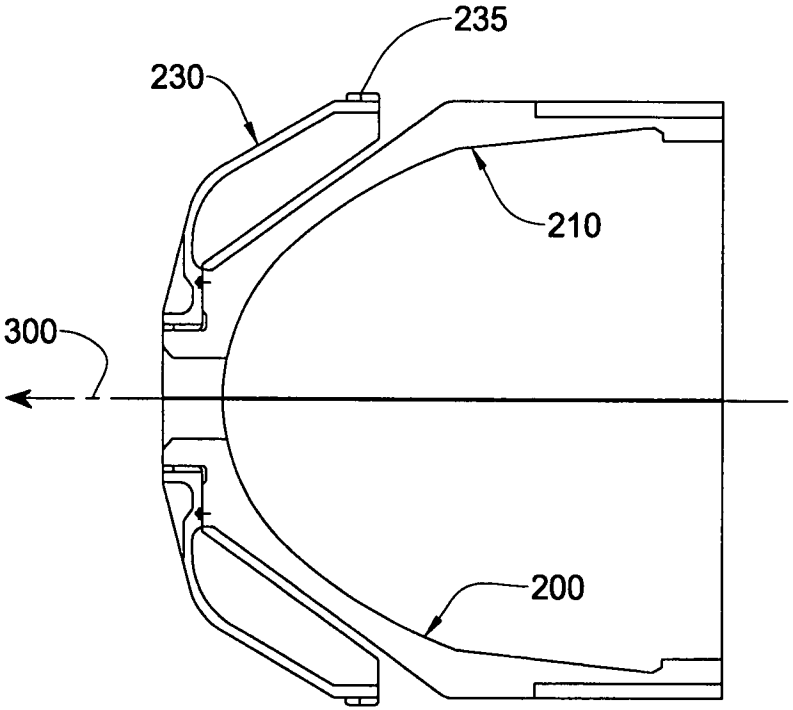
FIG. 12 is a simplified side cross-sectional illustration of a projectile head-protective element such as but not limited to a sabot and associated threaded separation prevention device constructed and operative in accordance with a second embodiment of the present invention, it being appreciated that the particular measurements provided are merely by way of example and are not intended to be limiting.
Figure 13A:
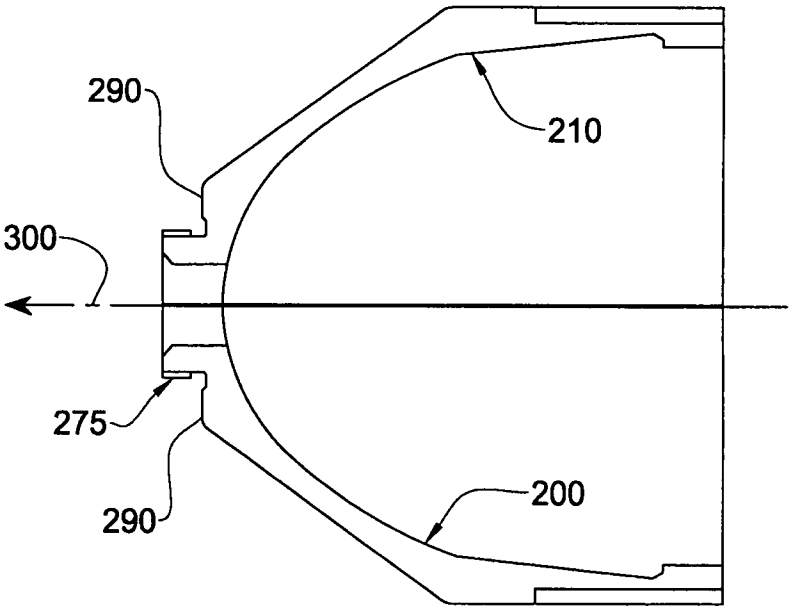
FIG. 13A is a simplified side cross-sectional illustration of one of a plurality, such as two, head-protecting element segments which together form the head-protecting element of FIG. 12.
Figure 13B:
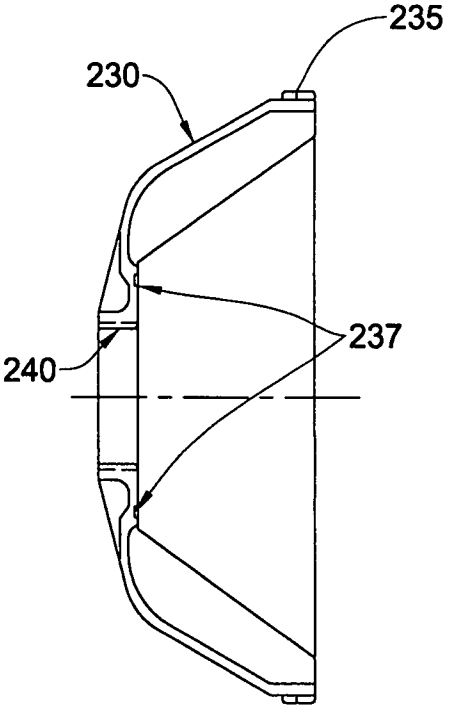
FIG. 13B is a simplified side cross-sectional illustration of the threaded separation prevention device of FIG. 12 which, as shown, is toothed.
Figure 14:
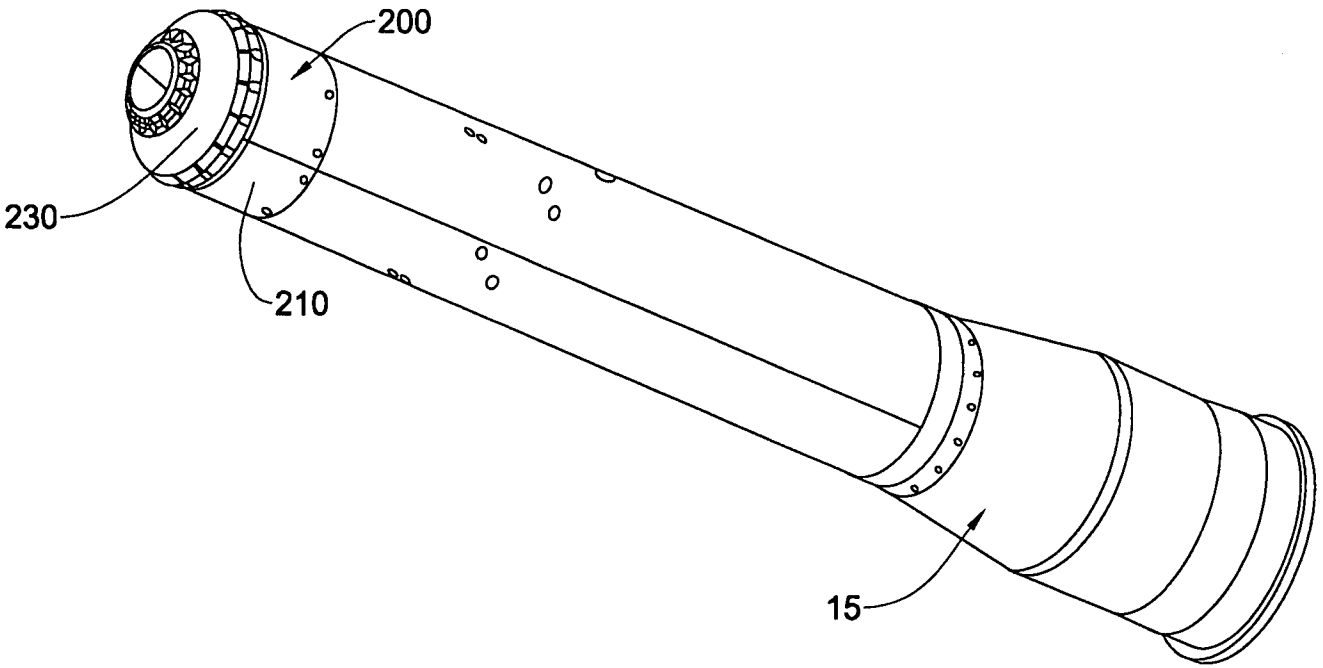
FIG. 14 is an isometric view of a missile with threaded release of a projectile head-protecting element such as a sabot, including the apparatus of FIGS. 12-13B.
Figure 19:
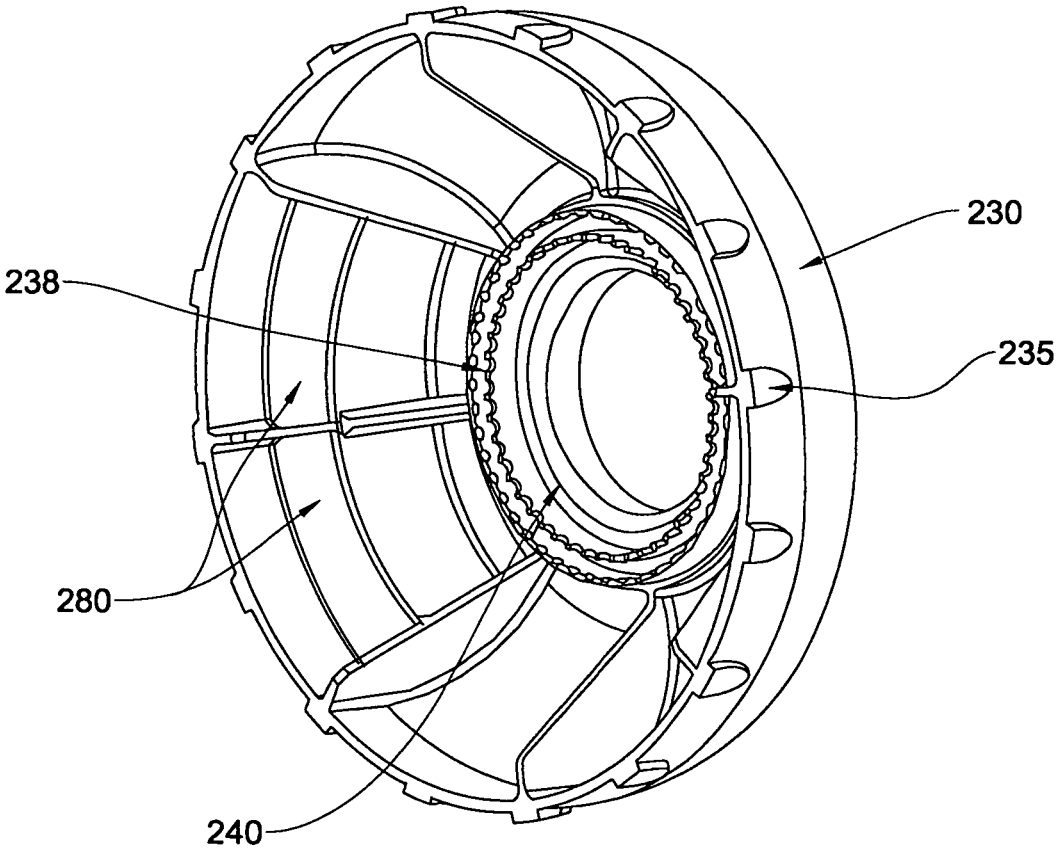
FIG. 19 is a back isometric view of a radially-unevenly weighted threaded toothed wheel particularly suited for the apparatus of FIGS. 12-14.

The internal surface 240 of the threaded separation prevention device, as shown in FIG. 19, is threaded to match the threading 215 on the external surface of the head-protecting element segment of FIG. 13A. During storage, wheel 230 of FIG. 13B is threaded onto the assembled head protecting element as shown in FIG. 12. When the projectile is loaded into the barrel, the teeth 235 of the wheel 230 engage the rifling of the barrel. When launch occurs, the forward motion of the projectile along the rifled barrel and the engagement between the toothed separation prevention device e.g. wheel 230 and the rifling causes the toothed separation prevention device e.g. wheel 230 to spin whereas the head-protecting element (e.g. 260 in FIG. 17) does not spin due to inertia and its smaller diameter. Therefore, the separation prevention device spins off the head-protecting element and disengages therefrom, which in turn releases the head-protecting element and allows it to disengage from the projectile before or alternatively just after it emerges from the barrel.

Typically, as in the first embodiment, projectile 10, being elongate, defines an axis along the forward direction and a circumference surrounding the axis and the head-protecting element includes a plurality of head-protecting element segments, such as 2-8 segments, including at least first and second head-protecting element segments 200 and 210. These segments are arranged about the circumference of the projectile. The rifled barrel 24 defines a first threading direction such as clockwise, and the toothed separation prevention device e.g. wheel 230 is peripheral to and in threaded engagement with the first and second head-protecting element segments 200 and 210 and defines a second threading direction which may be the same as the first threading direction e.g. clockwise.

The rifled barrel typically defines a first number of revolutions along the barrel, and the threaded engagement of the toothed separation prevention device e.g. wheel 230 with the head-protecting element 205 defines a second number of revolutions along the barrel which is smaller than the first number of revolutions such that the separation prevention device becomes unthreaded and slips off the head protecting element 205 before the projectile 10 emerges from the barrel.

As soon as the separation prevention device becomes unthreaded, the head-protecting element is effectively separated from the projectile 10 except that, of course, the internal walls of the barrel itself prevent full separation of the head-protecting element and projectile 10 until the two have emerged from the barrel at which point the wheel 230, which is already entirely unthreaded and spinning rapidly, is typically thrown aside. A suitable spring may facilitate initial separation of the head-protecting element from the projectile once the two have emerged from the barrel. While in storage and in the barrel, the head-protecting element is typically loosely secured to the projectile at the base of the projectile by suitable securing means 225 (FIG. 18) e.g. by a suitable bracket, such that once the head-protecting element segments have separated to a non-trivial extent from the projectile (say about 30 degrees), the base portions of the head-protecting element segments slip free from the base portion of the projectile.

Figure 15:
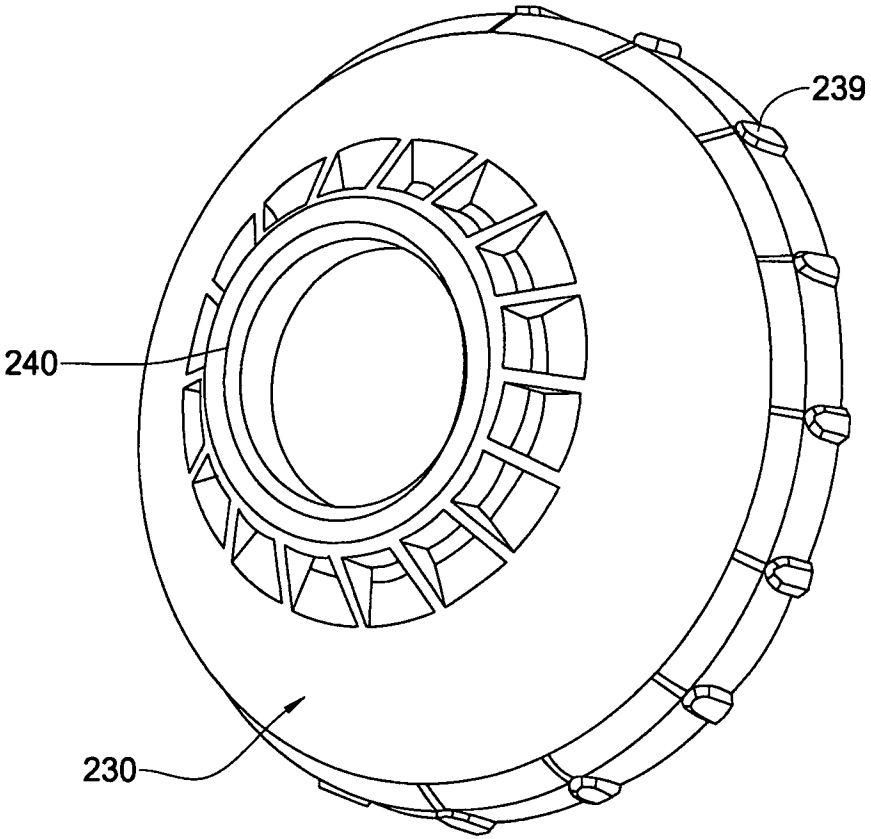
FIG. 15 is an isometric view of the threaded toothed wheel of FIGS. 12-14.
Figure 16:
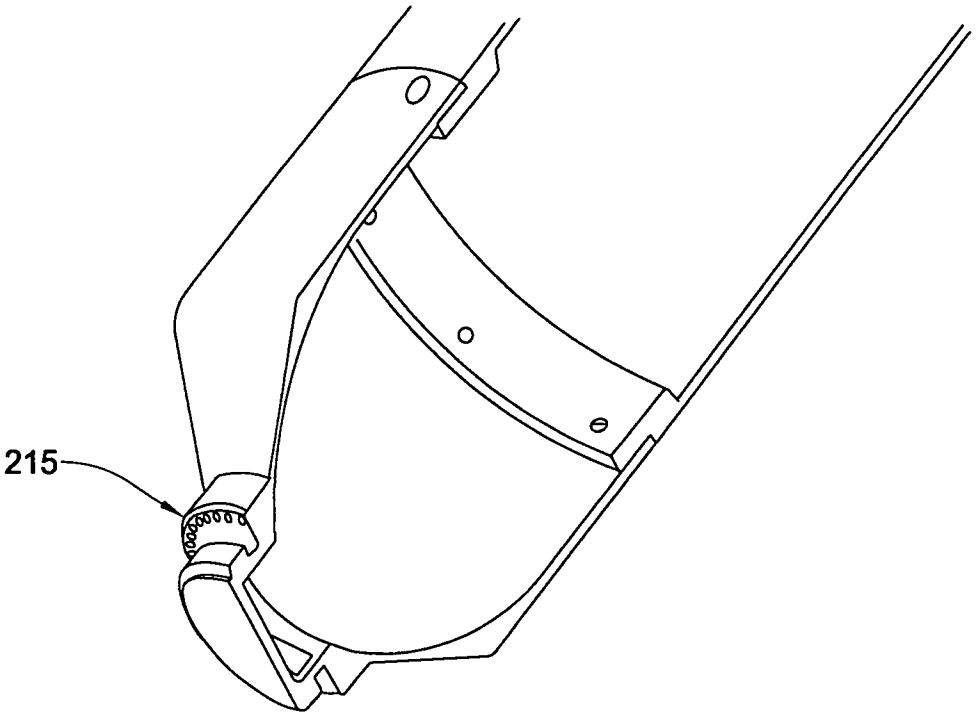
FIG. 16 is an isometric view of one of two identical head-protecting element segments configured and operative to interact with the threaded toothed wheel of FIG. 15.
Figure 17:
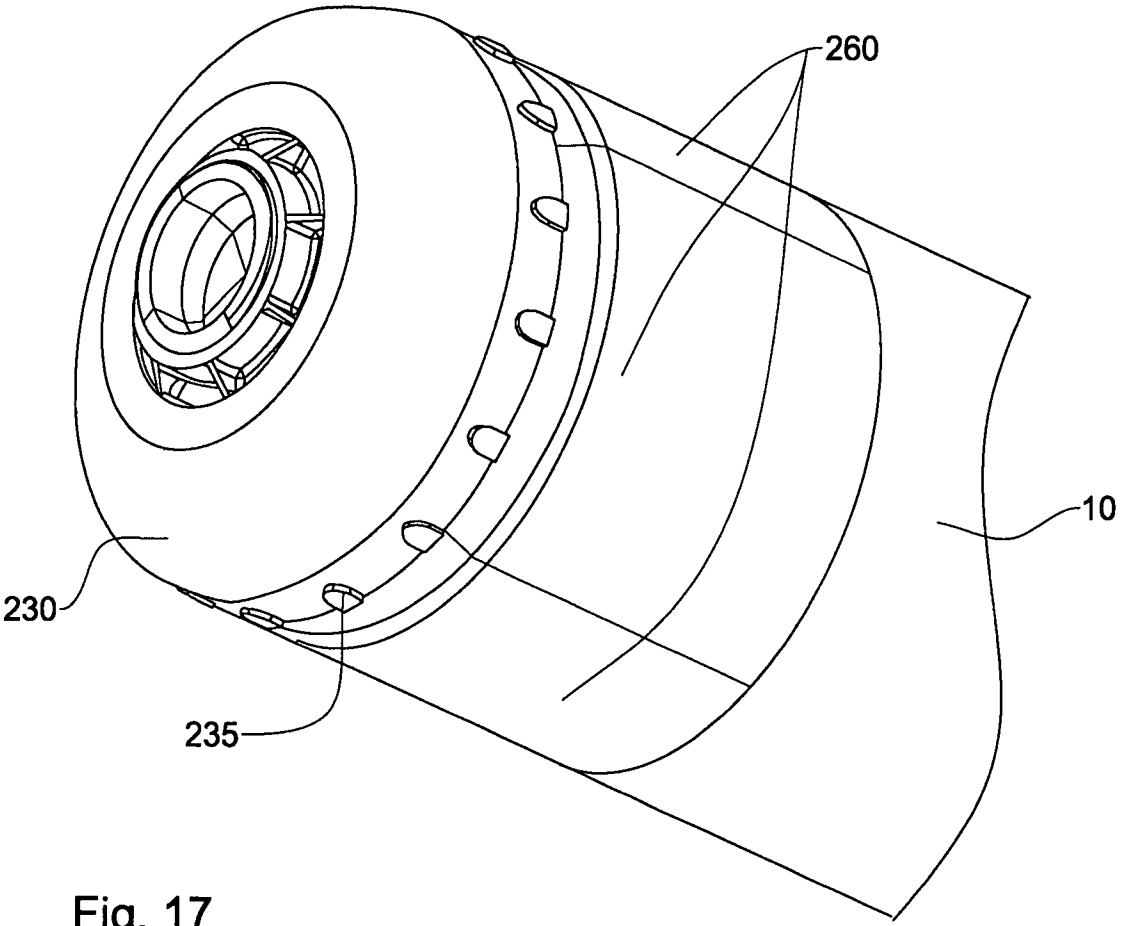
FIG. 17 is an isometric view of a projectile head-protecting element which need not comprise a sabot and may alternatively serve for projectile head-protection only, and which includes four azimuthal segments.
Figure 18:
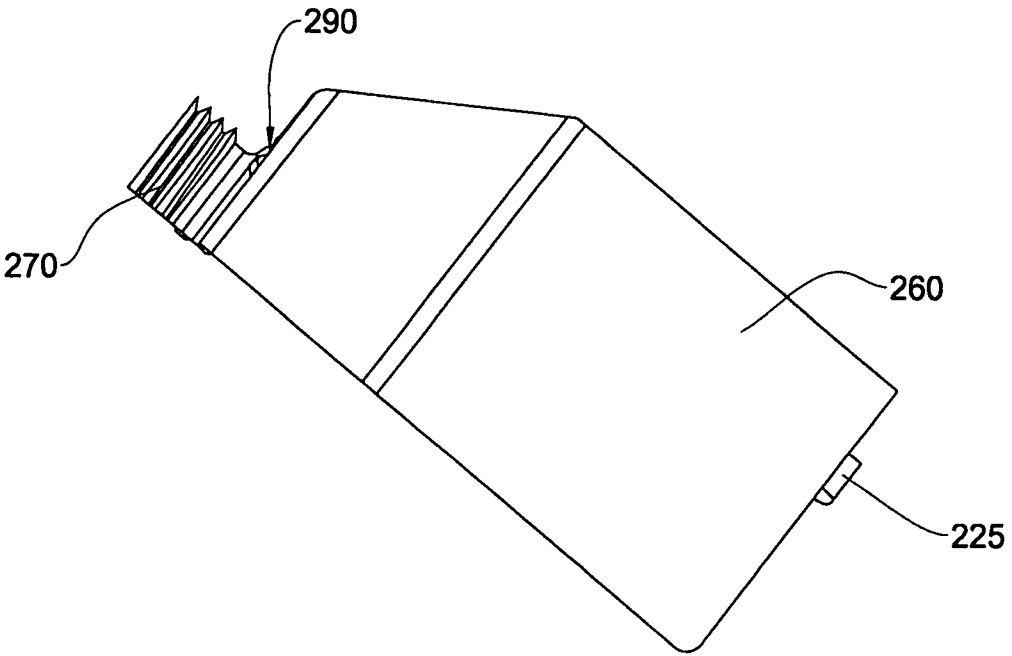
FIG. 18 is a forward isometric view of an individual one of a cap cover of one of the four azimuthal segments of FIG. 17.

FIG. 16 is an isometric view of one of two typically identical azimuthal protective element segments configured and operative to interact with the threaded toothed wheel of FIG. 15, each segment encasing one half or 180 degrees of the total projectile circumference and including a threaded half shaft 215 as shown e.g. as described above. The apparatus of FIG. 16 typically comprises a head-protecting element e.g. for applications in which a projectile with a 105 mm diameter is to be shot from a 120 mm barrel. In contrast, FIG. 17 is an isometric view of a projectile head-protecting element which need not comprise a sabot (e.g. if a 105 mm projectile having a head whose diameter is perhaps 103 mm, is shot from a 105 mm barrel) and may alternatively serve for projectile head protection only, and which includes four typically similar or identical azimuthal segments 260 of which three are visible, each encasing one quarter or 90 degrees of the total projectile circumference. FIG. 18 is a side view of an individual one of a cap cover of one of the four azimuthal segments 260 of FIG. 17 including a threaded quarter shaft 270 as shown e.g. as described above. It is appreciated that more generally, the number of azimuthal segments from which the projectile head-protecting element is formed, is not intended to be limiting.

As described above, when the head protecting element and the projectile 10 have emerged from the barrel, the rapidly rotating wheel 230, which is already entirely unthreaded, may be thrown aside. To ensure that the wheel is indeed thrown aside rather than interfering with the trajectory of the projectile 10, the wheel 230 is typically unevenly weighted (FIG. 19) such that a certain radial portion 280 of the wheel is heavier than other same-size radial portions of the wheel.

Example

The rifling in some firearms may be configured to form one turn per 18 barrel diameters yielding approximately 2 turns for the entire barrel length. For such firearms, the wheel 230 may include only a single turn to ensure its release before it exits the barrel.

Typically, the head-protecting element of FIG. 18 includes a protruding member 290 which, when the wheel 230 of FIG. 19 is screwed onto the head-protecting element of FIG. 18, comes into contact with the teeth ring 238 of FIG. 19. This results in a "click" fit between the wheel and cap cover which is advantageous in that it prevents inadvertent release of the wheel 230.

Features of the present invention which are described in the context of separate embodiments may also be provided in combination in a single embodiment. Conversely, features of the invention, including method steps, which are described for brevity in the context of a single embodiment or in a certain order may be provided separately or in any suitable subcombination or in a different order. "e.g." is used herein in the sense of a specific example which is not intended to be limiting.

The invention claimed is:

1. Weaponry apparatus comprising:

a projectile having a head end; and a projectile head-protecting element having a head end and surrounding at least a portion of a projectile head of the projectile and operative to separate from the projectile only as the projectile is launched, the projectile head-protecting element including a separation prevention device operative to hold the head ends of the head protective element and projectile together, until launch, and to allow the head ends of the head-protecting element and projectile to separate, during launch.

2. The apparatus according to claim 1 and also comprising a launching apparatus including a barrel from which the projectile is launched.

3. The apparatus according to claim 2 wherein the barrel comprises a smoothbore barrel.

4. The apparatus according to claim 1 wherein the projectile comprises a susceptible head which is susceptible to damage and wherein the projectile head-protecting element protects the susceptible head.

5. The apparatus according to claim 4 wherein the separation prevention device is operative to prevent the projectile head-protecting element from separating from the projectile until the following launch-indicative event has occurred: a current forward acceleration of the projectile reaches a level high enough to be indicative of launching.

6. The apparatus according to claim 1 wherein the projectile head-protecting element comprises a front portion of a projectile enveloping element enveloping at least a portion of the projectile other than the projectile head.

7. The apparatus according to claim 1 wherein the projectile defines an axis along a forward direction and a circumference surrounding the axis and wherein the projectile head-protecting element includes at least first and second projectile head-protecting element segments arranged about the circumference of the projectile, wherein the first projectile head-protecting element segment comprises a spring loaded weighted connector, having a first position, and a second position when a force contrary to a spring force is applied to the spring loaded weighted connector, wherein the spring loaded weighted connector is configured and arranged to connect the first projectile head-protecting element segment to the second projectile head-protecting element segment when the spring loaded weighted connector is in the first position and not when the spring loaded weighted connector is in the second position, and wherein the spring loaded weighted connector is positioned such that at least a portion of a forward acceleration of the projectile works against the spring force.

8. The apparatus according to claim 7 wherein the first projectile head-protecting element segment is no longer connected to the second projectile head-protecting element segment by the spring loaded weighted connector once the forward acceleration overcomes the spring force.

9. The apparatus according to claim 7 further comprising a connector disabler operative to prevent the spring loaded weighted connector from re-connecting the first and second projectile head-protecting element segments once the spring loaded weighted connector has reached the second position.

10. The apparatus according to claim 2 wherein the barrel comprises a rifled barrel, and the separation prevention device comprises a toothed separation prevention device operative to perform a spin motion around the projectile as the projectile and surrounding projectile head-protecting element move along the rifled barrel, the toothed separation prevention device being operative to prevent the projectile head-protecting element from separating from the projectile until the following launch-indicative event has occurred: at least one characteristic of the spin motion has reached a level unique to launching.

11. The apparatus according to claim 10 wherein the toothed separation prevention device includes pre-formed teeth.

12. The apparatus according to claim 10 wherein the characteristic comprises a number of times that the separation prevention device spins around the projectile and wherein the separation prevention device is operative to prevent the projectile head-protecting element from separating from the projectile until the number of times is high enough to be indicative of launching.

13. The apparatus according to claim 10 wherein the projectile defines an axis along a forward direction and a circumference surrounding the axis and wherein the projectile head-protecting element includes at least first and second projectile head-protecting element segments arranged about the circumference of the projectile, wherein the rifled barrel defines a first threading direction and wherein the separation prevention device is peripheral to and in threaded engagement with the first and second projectile head-protecting element segments, thereby to define a second threading direction which is the same as the first threading direction.

14. The apparatus according to claim 13 wherein the rifled barrel defines a first number of revolutions along the barrel and the threaded engagement of the device with the projectile head-protecting element defines a second number of revolutions, which is smaller than the first number of revolutions.

15. The apparatus according to claim 1 wherein the projectile has a forward acceleration during launch and wherein the launch-indicative event comprises a situation in which the forward acceleration of the projectile reaches a level high enough to be indicative of launching.

16. The apparatus according to claim 10 wherein the separation prevention device comprises a wheel whose weight is radially-unevenly distributed to promote sideways motion of the wheel, after the wheel has exited a barrel.

17. The apparatus according to claim 6 and wherein the projectile enveloping element comprises a sabot.

18. A method for providing a projectile, the method comprising:

providing a projectile having a head end; and providing a projectile head-protecting element having a head end and surrounding at least a portion of a projectile head and operative to separate from the projectile only as the projectile is launched, including providing a separation prevention device operative to hold the head ends of the head protective element and projectile together, until launch, and to allow the head ends of the head-protecting element and projectile to separate, during launch.

19. The method according to claim 18 wherein:

the projectile comprises a susceptible head which is susceptible to damage and wherein the projectile head-protecting element protects the susceptible head, and the separation prevention device is operative to prevent the head-protecting element from separating from the projectile until the following launch-indicative event has occurred: a current forward acceleration of the projectile reaches a level high enough to be indicative of launching.

20. The method according to claim 18 and also comprising providing launching apparatus including a barrel from which the projectile is launched, wherein the barrel comprises a rifled barrel, and the separation prevention device comprises a toothed separation prevention device operative to perform a spin motion around the projectile as the projectile and surrounding projectile head-protecting element move along the rifled barrel, the toothed separation prevention device being operative to prevent the projectile head-protecting element from separating from the projectile until the following launch-indicative event has occurred: at least one characteristic of the spin motion has reached a level unique to launching.

* * * * *